United States Patent [19]

Goralnik

[11] 4,356,540

[45] Oct. 26, 1982

[54] LIGHTING FIXTURE

[76] Inventor: Charles D. Goralnik, 200 Brynwyck Pl., St. Louis County, Mo. 63141

[21] Appl. No.: 174,272

[22] Filed: Jul. 31, 1980

Related U.S. Application Data

[63] Continuation-in-part of Ser. No. 934,461, Aug. 17, 1978, Pat. No. 4,234,916.

[51] Int. Cl.[3] ..... F21V 29/00

[52] U.S. Cl. ..... 362/294; 362/147; 362/148; 362/227; 362/249; 362/311; 362/367; 362/368; 362/375

[58] Field of Search ..... 362/294, 147, 148, 227, 362/249, 311, 367, 368, 375

[56] References Cited

U.S. PATENT DOCUMENTS

| | | | |
|---|---|---|---|
| 2,638,531 | 5/1953 | Levy | 240/47 |
| 2,918,569 | 12/1959 | McCormack | 240/128 |
| 4,044,246 | 8/1977 | Domimo et al. | 240/78 CF |
| 4,104,713 | 8/1978 | Chan et al. | 362/294 |

*Primary Examiner*—Stephen J. Lechert, Jr.

*Attorney, Agent, or Firm*—Senniger, Powers, Leavitt and Roedel

[57] ABSTRACT

A lighting fixture adapted to be mounted on a ceiling by attachment to an outlet box in the ceiling. The fixture comprises a pan having a bottom and a rim engageable with the ceiling for spacing the bottom of the pan therefrom, a crossbar attached to the bottom of the outlet box in position extending horizontally across the bottom of the box, and fasteners for detachably securing the rim of the pan to the crossbar. The lighting fixture also includes a first layer of insulation in the pan secured to the pan above the bottom thereof, a second layer of insulation secured on the underside of the bottom of the pan, and a light socket for mounting a light source on the underside of the pan below the second layer of insulation. A diffuser having an open top is mounted on the underside of the pan around the socket and the light source. The second layer of insulation is disposed above the light source for thermally insulating the light source from the pan and the outlet box to reduce the transfer of heat generated by the light source to the outlet box.

18 Claims, 3 Drawing Figures

LIGHTING FIXTURE

CROSS-REFERENCE TO RELATED APPLICATIONS

This application is a continuation-in-part of my copending U.S. patent application Ser. No. 934,461 filed Aug. 17, 1978, now U.S. Pat. No. 4,234,916.

BACKGROUND OF THE INVENTION

This invention relates to lighting fixtures of the type adapted to be mounted on a ceiling by attachment to an outlet box in the ceiling. This type of fixture, shown in the above-mentioned copending application, is sometimes referred to in the trade as a flush-mounted ceiling fixture.

Prior art lighting fixtures of this type generally comprise a fixture pan having a light socket secured to the bottom thereof, and a crossbar attached, as by screws, horizontally across the bottom of the outlet box. The pan is fastened to the crossbar by a screw (or screws) extending up through the pan and threaded through the crossbar, with the upper end of the screw projecting up into the outlet box. This arrangement has presented certain problems, however, inasmuch as the screw conducts heat generated by the light source up into the outlet box, resulting in unacceptably high temperatures in the outlet box which may damage the insulation on the wires in the outlet box, thereby presenting a fire hazard. The ceiling may also become overheated.

SUMMARY OF THE INVENTION

Among the several objects of this invention may be noted the provision of a lighting fixture of the aforementioned type which effectively reduces the amount of heat transferred from a light source within the fixture to the ceiling and outlet box; the provision of such a fixture which is pleasing in appearance; the provision of such a fixture which is easy to attach to an outlet box; the provision of such a fixture which may be readily mounted on a ceiling with the sides of the fixture aligned with the walls of a room; and the provision of such a fixture which is economical to manufacture.

In general, a lighting fixture of this invention is of the aforementioned type and comprises a pan having a bottom and a rim engageable with the ceiling for spacing the bottom of the pan therefrom, a crossbar adapted to be attached to the bottom of the outlet box, and means for fastening the rim of the pan to the crossbar. The lighting fixture further comprises a first layer of insulation in the pan secured to the pan above the bottom thereof, a second layer of insulation secured on the underside of the bottom of the pan, and means for mounting a light source on the underside of the pan below said second layer of insulation. A diffuser having an open top is provided and is adapted to be mounted on the underside of the pan around the mounting means and light source. The second layer of insulation is disposed above the light source for thermally insulating the light source from the pan and the outlet box to reduce the transfer of heat generated by the light source to the outlet box.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
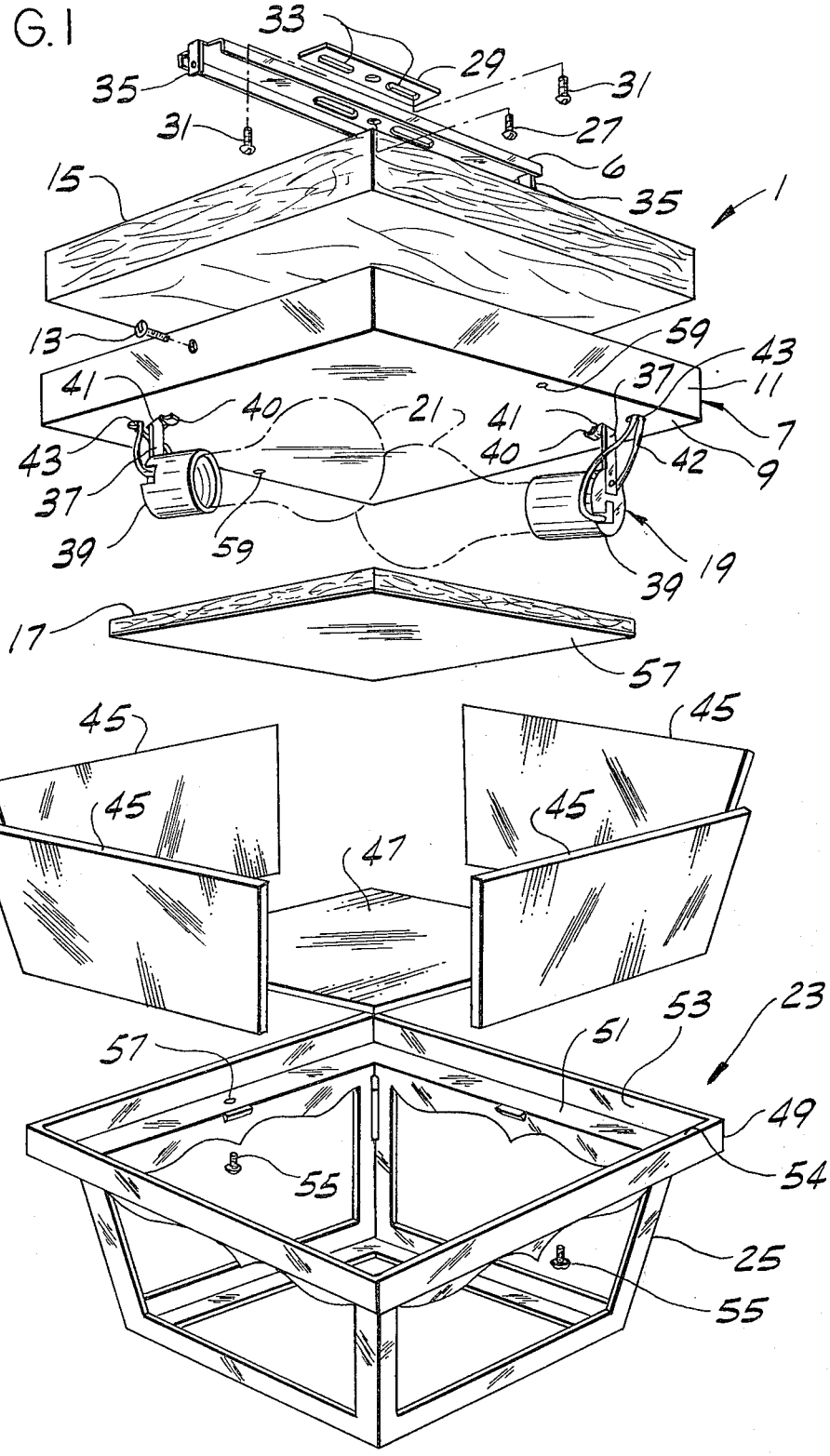
FIG. 1 is an exploded perspective of a lighting fixture of this invention.
Figure 2:
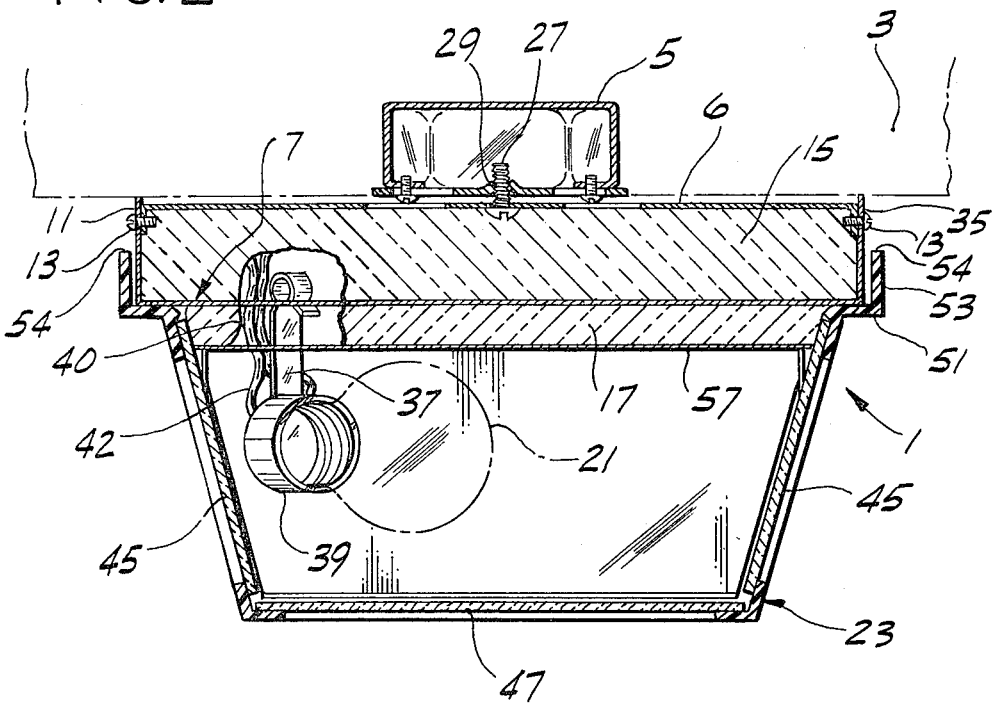
FIG. 2 is a vertical section of the lighting fixture shown mounted on a ceiling by attachment to an outlet box in the ceiling.

Referring to the drawings, particularly to FIGS. 1 and 2, a lighting fixture of this invention is designated generally by the reference numeral 1. As shown in FIG. 2, the fixture is adapted to be mounted on a ceiling 3 by attachment to a standard junction or outlet box 5 recessed in the ceiling. The fixture comprises a relatively narrow channel-shaped crossbar 6 attached to the bottom of the outlet box 5 in position extending horizontally across the bottom of the box and laterally outward beyond opposite sides of the box, and a rectangular pan 7 having a thin, relatively flat bottom 9 and a rim 11 extending upwardly therefrom. The rim is engageable at its upper edge with the ceiling 3 for spacing the bottom 9 of the pan from the ceiling. Means, such as screws 13, is provided for fastening the rim of the pan 7 to the crossbar.

The fixture 1 also includes a first (top) layer 15 of insulation in the pan 7, a second (bottom) layer 17 of insulation secured on the underside of the pan, and means generally indicated at 19 for mounting a light source, such as a pair of conventional incandescent light bulbs 21, on the bottom of the pan below the second layer of insulation. A diffuser 23 comprising a generally rectangular frame 25 having an open top is adapted to be mounted on the underside of the pan 7 around mounting means 19 and light bulbs 21.

As shown in FIG. 2, the crossbar 6 is pivotally connected, as by a pivot screw 27, to a mounting bar 29 secured in horizontal position across the bottom of the outlet box 5 by means of screws 31, which extend up through a pair of elongate slots 33 in the mounting bar and are threaded into the outlet box. Thus, the fixture 1 may be swiveled relative to the outlet box about a generally vertical axis (i.e., pivot screw 27) to enable the sides of the diffuser 23 to be readily aligned with the walls of a room. The crossbar 6 has downwardly extending flanges, each indicated at 35, at its ends and is of a length generally corresponding to the distance between opposite sides of the rim 11 of the pan thereby enabling the flanges 35 to extend down into the pan 7 and to interfit in face-to-face relation with the rim of the pan. The fact that the flanges 35 are on the inside of the rim 11 is advantageous inasmuch as they are concealed from view by the rim for enhancing the attractiveness of the lighting fixture. It will be understood, however, that the flanges could also extend on the outside of the rim without departing from the scope of this invention. As shown in FIG. 2, screws 13 extend through holes in opposite sides of the rim of the pan and are threaded into tapped holes in flanges 35 of the crossbar for securing the pan to the crossbar. Of course, it will be understood that the rim 11 of the pan may be fastened to the crossbar in other fashions.

Means 19 for mounting light bulbs 21 comprises a pair of brackets 37 secured to the underside of the pan adjacent diagonally opposite corners of the pan, and a pair of sockets 39, each of which is secured to the lower end of a respective bracket. The upper end of each bracket is doubled over on itself, forming a spring clip 40 received in a generally rectangular hole 41 in the bottom of the pan 7 for securing the bracket to the pan. The sockets mount the light bulbs beneath the pan 7 with the bulbs extending in generally side-to-side direction with respect to the pan. Each socket 39 is connected to a suitable electrical power source (not shown) by wires 42 which extend down from the outlet box 5 through a relatively small hole 43 in the bottom of the pan.

The diffuser 23 includes a plurality (e.g., five) of diffuser panels of suitable transparent or transluscent material (e.g., glass) held in frame 25. Four of these panels, each indicated at 45, are disposed in generally upright position in the frame at the sides of the light bulbs 21, and the fifth panel 47 is disposed in a generally horizontal position in the frame below the bulbs. The diffuser frame 25 has a peripheral L-shaped rim 49 at its open top comprising a generally horizontal portion 51 and a vertical portion 53. To detachably secure the diffuser 23 to the pan 7, a pair of fasteners (e.g., thumb screws) 55 are threaded up through openings 57 in the horizontal portion 51 of the rim into a pair of tapped holes 59 in the bottom 9 of the pan 7. With the exception of the holes 41, 43 and 59, which are relatively small, the bottom 9 of the pan is continuous and free of any openings therein.

Figure 3:
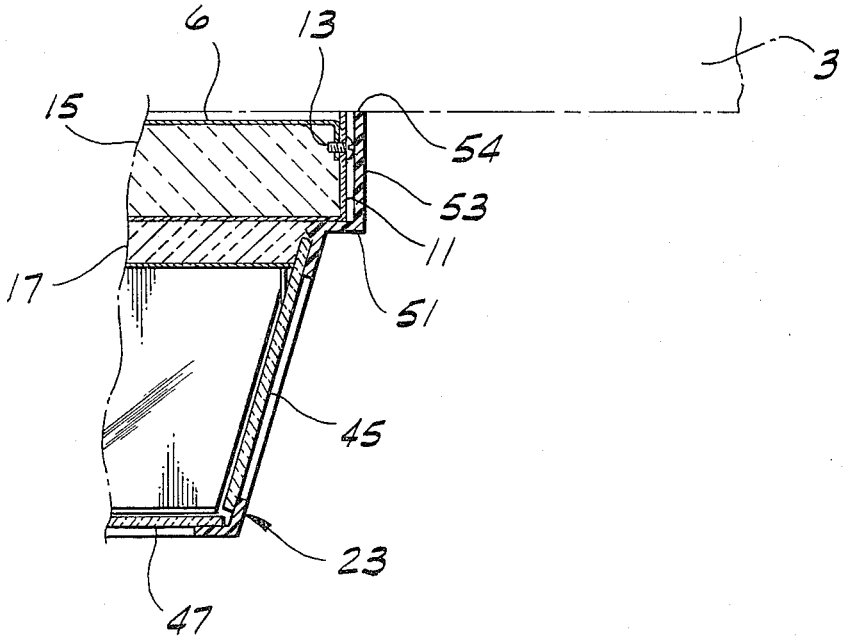
FIG. 3 is a fragmentary detail, illustrating an alternative construction of the lighting fixture.

With the diffuser 23 secured to the pan 7, the horizontal portion 51 of the diffuser rim extends below the pan in generally face-to-face relation with the bottom of the pan and the vertical portion 53 of the rim extends up in face-to-face relation with the rim 11 of the pan. As best illustrated in FIG. 2, the height of the vertical portion 53 of the diffuser rim is sufficiently less than that of the rim 11 of the pan 7 so that, with the diffuser mounted on the pan, the upper edge 54 of the diffuser rim is disposed below the level of screws 13, which is advantageous in that the screws are exposed to ambient air for increasing the dissipation of heat from the pan. Moreover, the screws are readily accessible for quick and easy attachment and detachment of the pan from the crossbar 6. It is also contemplated that vertical portion 53 of the diffuser rim may be of a height corresponding to that of the rim of the pan, as shown in FIG. 3, so that the upper edge of the diffuser rim 49 is generally coplanar with the upper edge of the rim 11 of the pan. In this embodiment, the diffuser rim covers the screws 13 to present a more finished appearance.

In accordance with this invention, the first (top) and second (bottom) layers of insulation 15, 17 are of a suitable material such as fiberglass which may be of the non-rigid compressible type. This is in contrast to relatively rigid insulation, such as asbestos or compressed fiberglass, which must be used in prior art fixtures of the type where the pan is attached to the crossbar by screws which extend up through the bottom of the pan. In a construction of this type, any insulation on the underside of the pan must be relatively rigid to enable the screws to be properly tightened up against the insulation. Applicants's rim-mounting design eliminates this need for rigidity and permits the use of non-rigid compressible fiberglass which has a higher insulation rating and is less expensive than rigid insulation.

As illustrated in FIG. 2, the top layer 15 of insulation is disposed in the recess formed by the rim 11 of the pan 7 and is preferably secured (as by suitable adhesive) to the bottom of the pan. The bottom layer 17 is similarly secured on the underside of the pan above the light bulbs 21. Its lower face is formed by a layer of light-reflective material 57 such as aluminum foil. With the diffuser 23 mounted on the pan, the bottom layer 17 of insulation is received inside the diffuser and is sized for a relatively close fit at its periphery with the generally vertical diffuser panels 45. Thus the diffuser 23 and bottom insulative layer 17 combine to define a substantially enclosed chamber for the light bulbs 21, with the bottom layer of insulation thermally insulating the light bulbs from the pan 7 and from the outlet box 5. This reduces the transfer of heat generated by the light bulbs to the outlet box, thereby preventing overheating of the box and adjacent areas of the ceiling 3. To further insulate the outlet box from the light bulbs, wires 42 extend up to the box through both layers 15, 17 of insulation.

Although the lighting fixture 1, shown and described above is generally rectangular in shape and mounted on a ceiling, it will be understood that the lighting fixture may be of other configurations (e.g., circular) and may be mounted on a wall or other structure. And, while the crossbar 6 is shown and described as being mounted to the outlet box 5 via the mounting bar 29 and pivot screw 27, it is contemplated that it could be mounted directly to the outlet box via screws extending up through slots in the crossbar.

It will be observed from the foregoing that the above-described lighting fixture 1 is effective to reduce the transfer of heat from the light source (light bulbs 21) upwardly to the ceiling 3 and outlet box 5. It should be noted in this regard that screws 13 fastening the rim 11 of pan 7 to the flanges 35 at the ends of crossbar 6, and fasteners 31 securing the crossbar to the outlet box are insulated from heat build-up in the diffuser 23 and pan 7 by the top and bottom layers 15, 17 of insulation above and below the bottom of the pan.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A lighting fixture adapted to be mounted on a ceiling by attachment to an outlet box in the ceiling, comprising a pan having a bottom and a rim engageable with the ceiling for spacing the bottom of the pan therefrom, a crossbar adapted to be attached to the bottom of the outlet box in position extending horizontally across the bottom of the box, means for fastening the rim of the pan to the crossbar, a first layer of insulation in the pan secured to the pan above the bottom thereof, a second layer of insulation secured on the underside of the bottom of the pan, means for mounting a light source on the underside of the pan below said second layer of insulation, and a diffuser having an open top adapted to be mounted on the underside of the pan around said mounting means and said light source with said second layer of insulation on the underside of the pan being disposed above the light source for thermally insulating it from the pan and the outlet box to reduce the transfer of heat generated by the light source to the outlet box.

2. A lighting fixture as set forth in claim 1 wherein said second layer of insulation is received inside the diffuser when the latter is mounted on the underside of the pan.

3. A lighting fixture as set forth in claim 1 wherein said diffuser and said second layer of insulation on the underside of the pan combine to define a substantially enclosed chamber for said light source.

4. A lighting fixture as set forth in claim 1 wherein said diffuser comprises a frame and a plurality of diffuser panels held by the frame in a generally upright position, said second layer of insulation on the underside of the pan being sized for a relatively close fit at its periphery with said panels.

5. A lighting fixture as set forth in claim 4 wherein said frame is generally rectangular and said diffuser comprises five diffuser panels, four of which are disposed in a generally upright position in the frame at the sides of the light source and the other of which is disposed in generally horizontal position in the frame below the light source.

6. A lighting fixture as set forth in claim 1 wherein said diffuser comprises a frame having an upwardly extending rim disposed around and generally in face-to-face relation with the rim of the pan.

7. A lighting fixture set forth in claim 6 wherein said rim of the pan is at the periphery of the pan and said rim of the diffuser comprises a generally horizontal portion on the underside of the pan generally parallel to the bottom of the pan and a vertical portion extending up adjacent to and in face-to-face relation with the rim of the pan.

8. A lighting fixture as set forth in claim 7 further comprising means for attaching said horizontal portion of the rim of the diffuser frame to the bottom of the pan.

9. A lighting fixture as set forth in claim 6 wherein the upper edge of the rim of the diffuser is disposed below the level of said fastening means when the diffuser is mounted on the pan.

10. A lighting fixture as set forth in claim 6 wherein the upper edge of the rim of the diffuser is generally coplanar with the upper edge of the rim of the pan when the diffuser is mounted on the pan.

11. A lighting fixture as set forth in claim 1 wherein the crossbar is pivotally connected to the outlet box for swinging movement about a generally vertical axis.

12. A lighting fixture as set forth in claim 1 wherein the crossbar has a flange extending downwardly from at least one of its ends, said rim of the pan being adapted to be fastened to the flange.

13. A lighting fixture as set forth in claim 12 wherein the flange interfits in face-to-face relation with the rim of the pan.

14. A lighting fixture as set forth in claim 1 wherein the bottom of the pan is thin and relatively flat.

15. A lighting fixture as set forth in claim 1 wherein said first layer of insulation is secured to the bottom of the pan.

16. A lighting fixture as set forth in claim 1 wherein said first and second layers of insulation are of fibrous compressible material.

17. A lighting fixture as set forth in claim 1 wherein said mounting means comprises a socket spaced below said second layer of insulation.

18. A lighting fixture as set forth in claim 1 wherein said light source comprises a pair of incandscent light bulbs, and said mounting means is adapted for mounting said bulbs in generally side-to-side direction with respect to said pan.

* * * * *